US007098853B2

(12) United States Patent
McGrath et al.

(10) Patent No.: US 7,098,853 B2
(45) Date of Patent: Aug. 29, 2006

(54) CONFORMAL CHANNEL MONOPOLE ARRAY ANTENNA

(75) Inventors: Daniel T. McGrath, McKinney, TX (US); Richard S. Johnson, McKinney, TX (US)

(73) Assignee: Raytheon Company, Waltham, MA (US)

( * ) Notice: Subject to any disclaimer, the term of this patent is extended or adjusted under 35 U.S.C. 154(b) by 8 days.

(21) Appl. No.: 10/895,652

(22) Filed: Jul. 21, 2004

(65) Prior Publication Data

US 2006/0017617 A1 Jan. 26, 2006

(51) Int. Cl.
*H01Q 1/38* (2006.01)
*H01Q 1/42* (2006.01)

(52) U.S. Cl. ..... 343/700 MS; 343/789

(58) Field of Classification Search ..... 343/700 MS, 343/789, 702, 895
See application file for complete search history.

(56) References Cited

U.S. PATENT DOCUMENTS 4,131,894 A * 12/1978 Schiavone ..... 343/700 MS
4,208,660 A * 6/1980 McOwen, Jr. ..... 343/769
4,766,444 A * 8/1988 Conroy et al. ..... 343/895
5,841,401 A * 11/1998 Bodley et al. ..... 343/700 MS
6,002,370 A * 12/1999 Mckinnon et al. ... 343/700 MS
6,121,936 A * 9/2000 Hemming et al. ..... 343/769
6,452,550 B1 * 9/2002 Channabasappa et al. ..... 343/700 MS
6,992,629 B1 * 1/2006 Kerner et al. ..... 343/700 MS
2002/0180644 A1 * 12/2002 Carson et al. ..... 343/700 MS
2003/0103006 A1 * 6/2003 Yamada ..... 343/700 MS
2004/0061656 A1 4/2004 McGrath ..... 343/776
2004/0150561 A1 * 8/2004 Tillery et al. ..... 343/700 MS
2005/0168383 A1 * 8/2005 Lee ..... 343/700 MS

* cited by examiner

*Primary Examiner*—HoangAnh Le
*Assistant Examiner*—Tung Le
(74) *Attorney, Agent, or Firm*—Baker Botts L.L.P.

(57) ABSTRACT

According to an embodiment of the present invention, a conformal channel monopole array antenna includes a base plate having a continuous electrically conducting channel formed therein, and a substrate coupled to the base plate. The substrate has a plurality of radiating elements formed on a first surface thereof. Each radiating element includes a radiating portion, a feed line, and a resistive end load. The feed lines are configured to couple to respective ones of a plurality of transmission elements.

24 Claims, 3 Drawing Sheets

CONFORMAL CHANNEL MONOPOLE ARRAY ANTENNA

TECHNICAL FIELD OF THE INVENTION

This invention relates in general to microstrip antennas and, more particularly, to a conformal channel monopole array antenna.

BACKGROUND OF THE INVENTION

Antennas with ultra-wide bandwidth have usually been too large to consider for arrays. Examples are spirals and log-periodic slots. They are also often inefficient because they are backed with absorber-filled cavities. The absorber attenuates the received RF power by one-half. Still other ultra-wideband antennas such as flared notches are very deep, resulting in unacceptable intrusion into, or protrusion from the supporting structure. On the other hand, antennas that are compact and amendable to conformal flush-mounting, are usually very narrowband. Examples are cavity-backed slots and microstrip patches. Their bandwidths are typically limited to less than 10%, or 1.1:1. Furthermore, their bandwidth decreases when they are used in arrays.

SUMMARY OF THE INVENTION

According to an embodiment of the present invention, a conformal channel monopole array antenna includes a base plate having a continuous electrically conducting channel formed therein, and a substrate coupled to the base plate. The substrate has a plurality of radiating elements formed on a first surface thereof. Each radiating element includes a radiating portion, a feed line, and an end load. The feed lines are configured to couple to a beamformer.

Embodiments of the invention provide a number of technical advantages. Embodiments of the invention may include all, some, or none of these advantages. For example, in one embodiment, a compact, low-profile antenna has moderate bandwidth and is suitable for line-source arrays. Its gain vs. frequency performance is comparable to spirals and log-periodic slots, but its compact size allows many radiators to be packed together, so that they are less than one wavelength apart at the highest frequency of operation.

Some applications may accept reduced efficiency at the edges of the operating frequency band. For this extended-frequency coverage, it may still be necessary that the antenna have low voltage standing wave ratio (VSWR), even at the band edges, to prevent oscillations on the line connecting the antenna to the electronic circuitry. For these situations, an antenna according to one embodiment of the invention allows a convenient method for including a resistive end load for VSWR reduction.

The present invention achieves ultra-widebandwith (up to 10:1) with moderately high efficiency while remaining very shallow (approximately 0.05 wavelengths at the lowest frequency).

Other technical advantages are readily apparent to one skilled in the art from the following figures, descriptions, and claims.

DETAILED DESCRIPTION OF THE INVENTION

Embodiments of the present invention and some of their advantages are best understood by referring to FIGS. 1 through 5 of the drawings, like numerals being used for like and corresponding parts of the various drawings.

Figure 1:
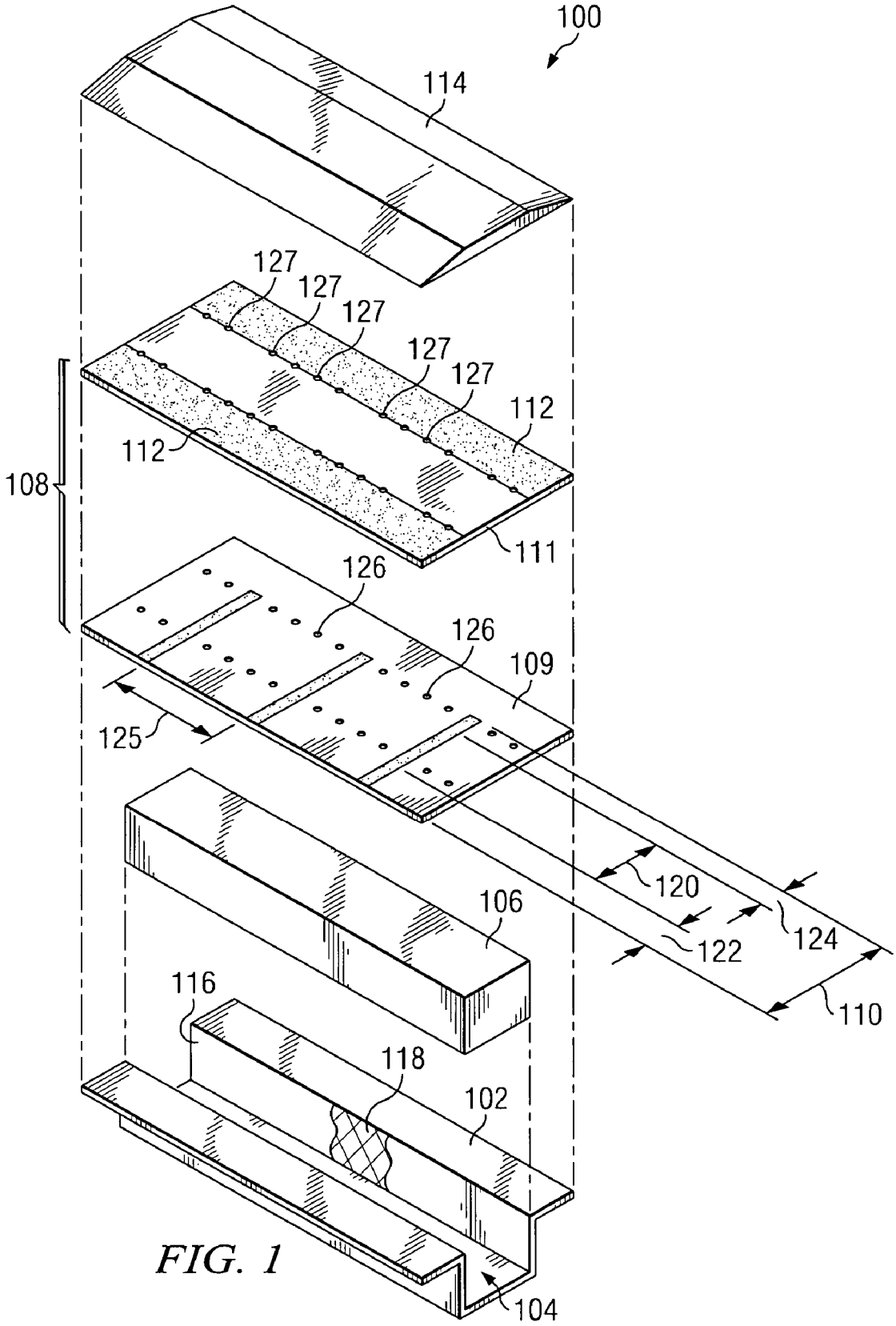
FIG. 1 is an exploded perspective view of stripline construction of a line-source array including a radome according to one embodiment of the present invention.

FIG. 1 is an exploded perspective view of a conformal channel monopole array antenna 100 according to one embodiment of the present invention. In the illustrated embodiment, antenna 100 includes a base plate 102 having a continuous channel 104 formed therein, a dielectric material 106, a substrate 108 comprised of a first layer 109 having a plurality of radiating elements 110 formed thereon and a second layer 111 having a pair of ground planes 112 formed thereon, and a radome 114. The present invention contemplates more, less, or different components than those illustrated in FIG. 1. In addition, other embodiments of antenna 100 are illustrated below in conjunction with FIGS. 2 through 5.

Base plate 102 may be any suitable size and shape and may be formed from any suitable material. For example, the material for base plate 102 may be any suitable metal or any suitable metal coating 118 on a non-metallic material, such as plastic. Continuous channel 104 is an electrically conducting channel formed along the length of base plate 102. The continuous nature of channel 104 extends the bandwidth of antenna 100 by increasing the electrical volume therein. Although channel 104 is illustrated in FIG. 1 as having generally parallel and upright walls 116, walls 116 may be sloped or may have other suitable configurations. The depth of channel 104 is determined approximately by the following formula: $0.2*\lambda_o/\mathrm{sqrt}(\epsilon_r)$, where $\lambda_o$ equals the center frequency wavelength and $\epsilon_r$ equals the relative permittivity of the dielectric material 106.

Dielectric material 106, which is optional for antenna 100, is illustrated in FIG. 1 as being disposed within channel 104 and substantially conforming to the shape of channel 104; however, alternate shapes that only partially fill the channel are also contemplated by the present invention. In one embodiment, dielectric material 106 is a material with low loss at microwave frequencies.

Substrate 108 is formed from first layer 109 and second layer 111, which both may have any suitable size and shape and may be formed from any suitable material, for example circuit card material may be utilized.

As described above, first layer 109 includes a plurality of radiating elements 110 formed therein. Radiating elements 110 may be formed within first layer 109 using any suitable fabrication method, such as photolithography. Any suitable number of radiating elements may be formed on first layer 109 and they may be spaced apart any suitable distance 125, usually less than one wavelength at the highest frequency of operation for antenna 100. Each radiating element 110 comprises a radiating portion 120, a feed line 122, and an optional resistive end load 124.

Radiating portion 120 may have any suitable shape; however, in the illustrated embodiment, the shape of radiating portion 120 is rectangular. Other suitable shapes, such as triangular and elliptical may be utilized for radiating portion 120. The function of radiating portion 120 is to radiate signals received through feed line 122.

Feed line 122 may have any suitable shape and may couple to radiating portion 120 in any suitable manner. Feed line 122 may receive the incoming signals from any suitable source. For example, feed line 122 may receive signals perpendicular through base plate 102 or may receive signals from components that are formed in first layer 109, such as amplifiers and phase shifters.

Resistive end load 124 may also be any suitable shape and may be coupled to radiating portion 120 in any suitable manner. Resistive end loads 124 generally function to absorb the ringing caused by the residual energy of antenna 100. A suitable choice of resistor provides low voltage standing wave ratio (VSWR) over the operating bandwidth for antenna 100. In one embodiment, resistivity of resistive end load 124 is chosen to minimize VSWR while maximizing the radiating efficiency. Typically, resistance should be larger than the characteristic impedance of feed line 122. However, if VSWR and bandwidth requirements allow, it may have zero resistivity.

As described above, second layer 111 includes ground planes 112, which may be formed from any suitable material and formed in second layer 111 using any suitable method. Ground planes 112 may include a plurality of plated vias 126 and 127. Plated vias 126 are also formed in first layer 109 in order to couple radiating elements 110 to continuous channel 104.

Radome 114 may be any suitable size and shape and may be formed from any suitable material that is transparent to radio frequencies.

Figure 2:
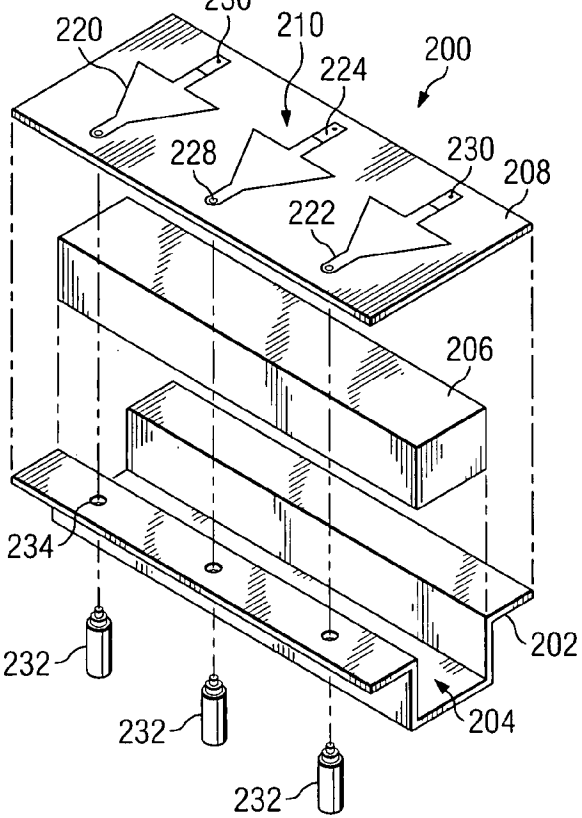
FIG. 2 is an exploded perspective view of microstrip construction of a line source array according to another embodiment of the present invention.

FIG. 2 is an exploded perspective view of an antenna 200 according to another embodiment of the present invention. Antenna 200 is similar to antenna 100 in FIG. 1, except that it uses a single substrate layer instead of two. Antenna 200 includes a substrate 208 having a plurality of radiating elements 210 formed therein. Radiating elements 210 include a radiating portion 220, a feed line 222, and a resistive end load 224.

Radiating portion 220 functions in a similar manner to radiating portion 120 in FIG. 1. In one embodiment, radiating portion 220 is triangular in shape; however, other suitable shapes for radiating portion 220 are contemplated by the present invention.

Radiating portion 220 couples to feed line 222, which may have any suitable length and any suitable shape. Feed line 222 includes a contact via 228 that couples to a respective coaxial cable 232 in order to receive signals. Resistive end load 224 may also have any suitable size and shape and may couple to radiating portion 220 in any suitable manner. Resistive end load 224 functions in a similar manner to resistive end load 124 FIG. 1; however, in the illustrated embodiment, resistive end load 224 includes a grounding pin 230 that couples to base plate 202.

In order to couple coaxial cables 232 to respective feed lines 222, a plurality of apertures 234 may be formed in base plate 202. Similar to base plate 102 of FIG. 1, base plate 202 includes a continuous channel 204 that is electrically conducting. Antenna 200 may also have a dielectric material 206 within channel 204 that is similar to dielectric material 106 of FIG. 1. A radome (not illustrated) may also be associated with antenna 200.

Figure 3:
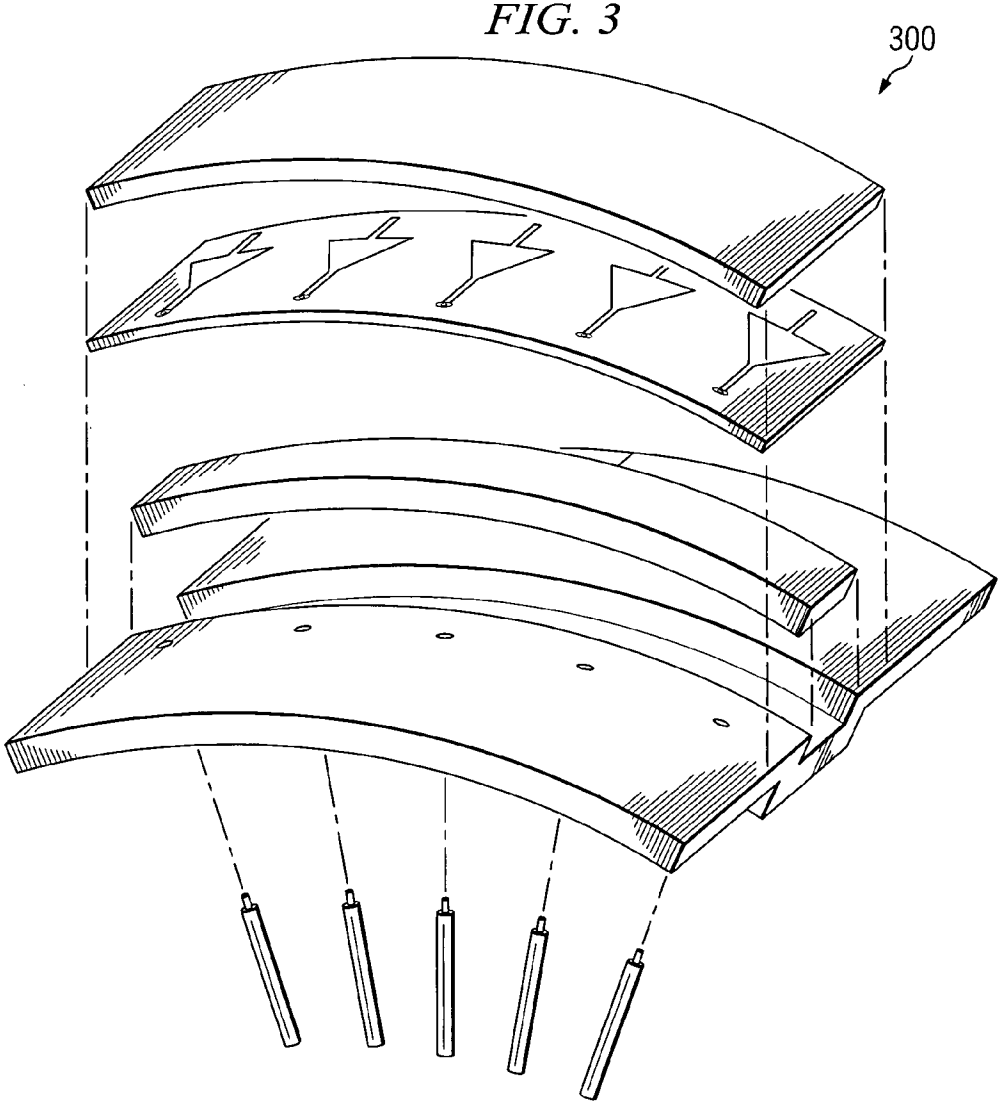
FIG. 3 is an exploded perspective view of microstrip construction of a line source array conforming to a curved surface according to another embodiment of the present invention.

FIG. 3 is an exploded perspective view of an antenna 300 according to another embodiment of the present invention. Antenna 300 is similar to antenna 200 illustrated in FIG. 2; however, antenna 300 in the embodiment illustrated in FIG. 3 includes components that are curved in order to conform to a curved shape, such as an aircraft fuselage. Antenna 300 may include stripline radiating elements, such as those shown in FIG. 1, in lieu of the microstrip radiating elements illustrated.

Figure 4:
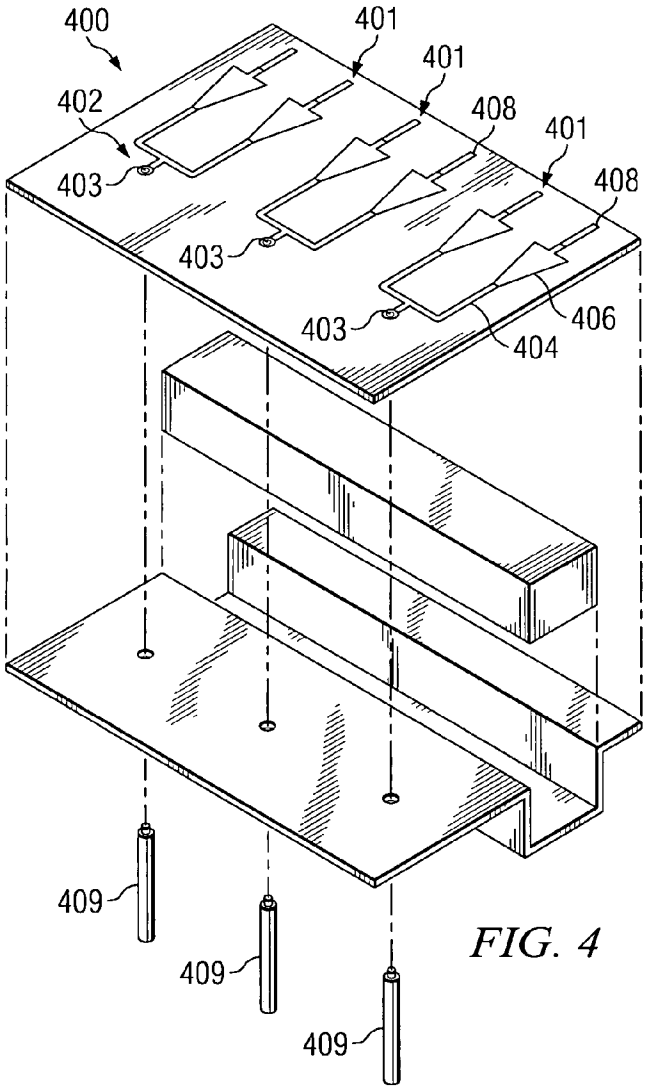
FIG. 4 is an exploded perspective view of microstrip construction of a line source array using split feeds according to another embodiment of the present invention.

FIG. 4 is an exploded perspective view of an antenna 400 according to another embodiment of the present invention. Antenna 400 is similar to antenna 200 illustrated in FIG. 2, except that in the embodiment illustrated in FIG. 4, antenna 400 includes a plurality of power dividers 402 each coupled to respective pairs of feed lines 404. Each feed line 404 is associated with a radiating element 401 also having a radiating portion 406 and a resistive end load 408. Each power divider 402 has a contact portion 403 that couples to a respective coaxial cable 409 for receiving signals.

Power dividers 402 function to split the feed power in half, which leads to two separate radiating elements 401. This pairing up of radiating elements 401 may allow a closer spacing for radiating elements 401, which prevents grating lobes at higher frequencies for antenna 400. Although triangularly shaped radiating portions 406 are illustrated in FIG. 4, radiating portions 406 may have any suitable shape.

Figure 5:
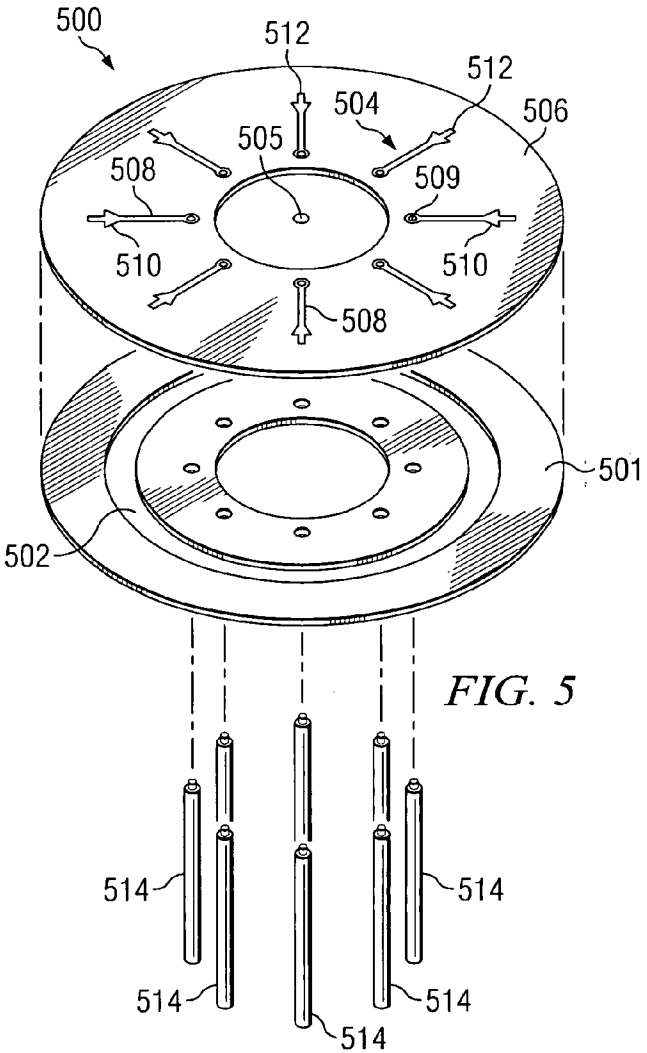
FIG. 5 is an exploded perspective view of microstrip construction of a ring array according to another embodiment of the present invention.

FIG. 5 is an exploded perspective view of an antenna 500 according to another embodiment of the present invention. In one embodiment, antenna 500 is particularly suitable for direction-finding applications and may be used in place of spiral antennas. In the illustrated embodiment, antenna 500 includes an annular channel 502 formed in a base plate 501, which may be any suitable size and shape. Channel 502 is a continuous electrically conducting channel that is disposed beneath a plurality of radiating elements 504 each radially extending from a center 505 of a substrate 506. Radiating elements 504 are similar to radiating elements of FIG. 2 and include a feed line 508, a radiating portion 510, and a resistive end load 512. Feed lines 508 also include a contact via 509 that couples to a respective coaxial cable 514 for receiving signals therefrom.

Thus, embodiments of the invention provide antennas that are compact, wideband, arrayable, efficient, and broadbeam. Some embodiments of the antennas described above in conjunction with FIGS. 1 through 5 are low profile for ease of installation on aircraft and missiles, and have bandwidths that exceed a 5:1 ratio.

Although embodiments of the invention and some of their advantages are described in detail, a person skilled in the art could make various alterations, additions, and omissions without departing from the spirit and scope of the present invention as defined by the appended claims.

What is claimed is:

1. A system, comprising:

a base plate having a continuous electrically conducting channel formed therein;

a substrate coupled to the base plate, the substrate having a plurality of radiating elements formed on a first surface thereof, each radiating element comprising:

a radiating portion;

a feed line; and a resistive end load; and wherein the feed lines are configured to couple to respective ones of a plurality of transmission elements;

wherein the continuous electrically conducting channel extends across the plurality of radiating elements.

2. The system of claim 1, further comprising a dielectric material disposed within the channel and substantially conforming to the shape of the channel.

3. The system of claim 1, wherein the channel comprises a pair of opposed walls each having metal plates coupled thereto.

4. The system of claim 1, wherein the channel and substrate are curved.

5. The system of claim 1, wherein the channel is annular.

6. The system of claim 1, further comprising a radome coupled to the substrate.

7. The system of claim 1, wherein a shape of the radiating portion is selected from the group consisting of triangular, elliptical, and rectangular.

8. The system of claim 1, wherein the feed lines are selected from the group consisting of microstrip feed lines and stripline feed lines.

9. The system of claim 1, further comprising one or more power dividers coupled to respective pairs of feed lines.

10. A conformal channel monopole array antenna, comprising:

an annular base plate having a annular electrically conducting channel formed therein;

an annular substrate coupled to the base plate, the annular substrate having a plurality of radially extending radiating elements formed on a first surface thereof, each radiating element comprising:

a radiating portion;

a feed line; and a resistive end load; and a plurality of transmission elements coupled to respective ones of the feed lines.

11. The system of claim 10, further comprising a dielectric material disposed within the channel and substantially conforming to the shape of the channel.

12. The system of claim 10, wherein the channel comprises a pair of opposed walls each having metal plates coupled thereto.

13. The system of claim 10, further comprising a radome coupled to the substrate.

14. The system of claim 10, wherein a shape of the radiating portion is selected from the group consisting of triangular, elliptical, and rectangular.

15. A conformal channel monopole array antenna, comprising:

a substrate having a plurality of radiating elements formed on a first surface thereof; and a base plate having a continuous electrically conducting channel formed therein, the channel disposed beneath the radiating elements;

wherein the continuous electrically conducting channel extends across the plurality of radiating elements.

16. The system of claim 15, wherein the radiating elements each comprise a radiating portion, a feed line, and a resistive end load.

17. The system of claim 16, wherein the feed lines are selected from the group consisting of micro strip feed lines and strip line feed lines.

18. The system of claim 16, wherein a shape of the radiating portion is selected from the group consisting of triangular, elliptical, and rectangular.

19. The system of claim 15, further comprising a dielectric material disposed within the channel and substantially conforming to the shape of the channel.

20. The system of claim 15, wherein the channel and substrate are curved.

21. The system of claim 15, wherein the channel is annular.

22. The system of claim 15, further comprising a plurality of power dividers formed on the first surface and coupled to respective pairs of the radiating elements.

23. The system of claim 15, wherein the substrate comprises a first layer having the radiating elements formed therein, and a second layer having one or more ground planes formed therein.

24. A system comprising:

a conformal channel monopole array antenna, comprising:

a base plate having a continuous electrically conducting channel formed therein;

a substrate coupled to the base plate, the substrate having a plurality of radiating elements formed on a first surface thereof, each radiating element comprising:

a radiating portion;

a feed line; and a resistive end load; and wherein the feed lines are configured to couple to respective ones of a plurality of transmission elements;

wherein the continuous electrically conducting channel extends across the plurality of radiating elements.

* * * * *

US007098853C1

(12) EX PARTE REEXAMINATION CERTIFICATE (7824th)

United States Patent
McGrath et al.

(10) Number: US 7,098,853 C1
(45) Certificate Issued: Oct. 19, 2010

(54) CONFORMAL CHANNEL MONOPOLE ARRAY ANTENNA

(75) Inventors: Daniel T. McGrath, McKinney, TX (US); Richard S. Johnson, McKinney, TX (US)

(73) Assignee: Raytheon Company, Waltham, MA (US)

Reexamination Request:
No. 90/008,440, Mar. 23, 2007

Reexamination Certificate for:

| | |
|---|---|
| Patent No.: | **7,098,853** |
| Issued: | **Aug. 29, 2006** |
| Appl. No.: | **10/895,652** |
| Filed: | **Jul. 21, 2004** |

(51) Int. Cl.
*H01Q 1/38* (2006.01)
*H01Q 1/42* (2006.01)

(52) U.S. Cl. ..... 343/700 MS; 343/789
(58) Field of Classification Search ..... None
See application file for complete search history.

(56) References Cited

U.S. PATENT DOCUMENTS

| | | | | |
|---|---|---|---|---|
| 3,750,185 | A | 7/1973 | Evans | 343/814 |
| 5,289,198 | A | 2/1994 | Altshuler | 343/729 |
| 6,140,972 | A | 10/2000 | Johnston et al. | 343/725 |
| 6,850,738 | B2 * | 2/2005 | Nokkonen et al. | 455/83 |
| 6,864,851 | B2 * | 3/2005 | McGrath | 343/776 |

OTHER PUBLICATIONS

Decision to refuse a European Patent application, EPO, Application No. 05 254 431.9–2220, Red. JL5418, 13 pages, Apr. 16, 2009.

Rao et al., "Wideband Phased Array of Coaxially–fed Probes in Parallel Plate Waveguides," Naval Research Laboratory, XP–002265717, pp. 290–293, 1987.

* cited by examiner

*Primary Examiner*—Pia Tibbits

(57) ABSTRACT

According to an embodiment of the present invention, a conformal channel monopole array antenna includes a base plate having a continuous electrically conducting channel formed therein, and a substrate coupled to the base plate. The substrate has a plurality of radiating elements formed on a first surface thereof. Each radiating element includes a radiating portion, a feed line, and a resistive end load. The feed lines are configured to couple to respective ones of a plurality of transmission elements.

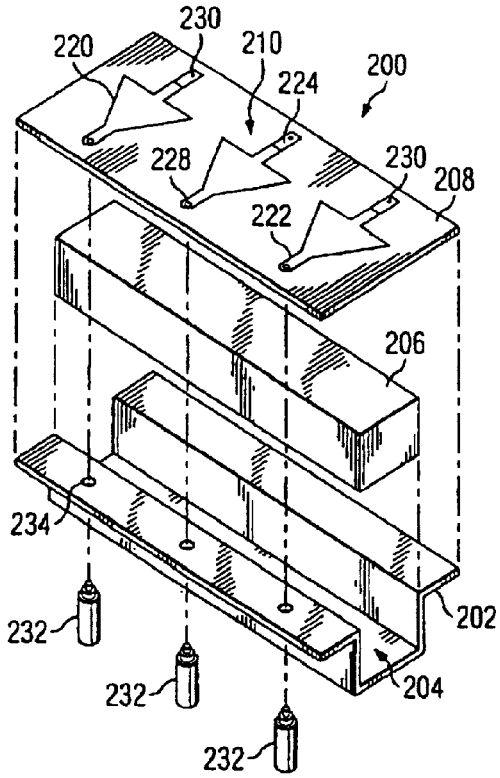

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1, 10, 15, 16, and 24 are determined to be patentable as amended.

Claims 2-5, 7, 8, 11, 12, 14, and 17-21, dependent on an amended claim, are determined to be patentable.

New claims 25-31 is added and determinded to be patentable.

Claims 6, 9, 13, 22, and 23 were not reexamined.

1. A system, comprising:

a base plate having a continuous electrically conducting channel formed therein;

a substrate coupled to the base plate, the substrate having a plurality of radiating elements formed on a first surface thereof, each radiating element comprising:

a radiating portion;

a feed line *formed on the first substrate, the feed line including a coaxial cable contact formed on the first substrate for coupling to a coaxial cable in order to receive signals*; and a resistive end load; and wherein the feed lines are configured to couple to respective ones of a plurality of transmission elements;

wherein the continuous electrically conducting channel extends across the plurality of radiating elements.

10. A conformal channel monopole array antenna, comprising:

an annular base plate having a annular electrically conducting channel formed therein;

an annular substrate coupled to the base plate, the annular substrate having a plurality of radially extending radiating elements formed on a first surface thereof, each radiating element comprising:

a radiating portion;

a feed line *formed on the annular substrate, the feed line including a coaxial cable contact formed in the annular substrate for coupling to a coaxial cable in order to receive signals*; and a resistive end load; and a plurality of transmission elements coupled to respective ones of the feed lines.

15. A conformal channel monopole array antenna, comprising:

a substrate having a plurality of radiating elements formed on a first surface thereof, *each radiating element including a radiating portion, a feedline, and a coaxial cable contact formed on the first surface for coupling to a coaxial cable in order to receive signals*; and a base plate having a continuous electrically conducting channel formed therein, the channel disposed beneath the radiating elements;

wherein the continuous electrically conducting channel extends across the plurality of radiating elements.

16. The system of claim 15, wherein [the radiating elements each comprise a radiating portion, a feed line, and]*each radiating element further comprises* a resistive end load.

24. A system comprising:

a conformal channel monopole array antenna, comprising:

a base plate having a continuous electrically conducting channel formed therein;

a substrate coupled to the base plate, the substrate having a plurality of radiating elements formed on a first surface thereof, each radiating element comprising:

a radiating portion;

a feed line *formed on the first surface, the feed line including a coaxial cable contact formed on the first surface for coupling to a coaxial cable in order to receive signals*; and a resistive end load; and wherein the feed lines are configured to couple to respective ones of a plurality of transmission elements;

wherein the continuous electrically conducting channel extends across the plurality of radiating elements.

*25. The system of claim 1, wherein the coaxial cable extends entirely outside of the continuous electrically conducting channel.*

*26. The system of claim 10, wherein the coaxial cable extends entirely outside of the continuous electrically conducting channel.*

*27. The system of claim 15, wherein the coaxial cable extends entirely outside of the continuous electrically conducting channel.*

*28. A system, comprising:*

*a base plate having a continuous electrically conducting channel formed therein;*

*a substrate coupled to the base plate, the substrate having a plurality of radiating elements formed on a first surface thereof, each radiating element comprising:*

*a radiating portion formed on the first surface of the substrate;*

*a feed line formed on the first surface of the substrate, the feed line extending in the same plane as the radiating portion from the radiating portion to a coaxial cable contact formed on the first surface of the substrate; and*

*a resistive end load; and*

*wherein the feed lines are configured to couple to respective ones of a plurality of transmission elements;*

*wherein the continuous electrically conducting channel extends across the plurality of radiating elements.*

*29. The system of claim 28, wherein the coaxial cable extends entirely outside of the continuous electrically conducting channel.*

*30. The system of claim 1, wherein the base plate includes a plurality of apertures extending perpendicularly through the base plate, each aperture for receiving a coaxial cable extending perpendicularly through the base plate.*

*31. The system of claim 1, wherein the substrate further comprises a plurality of power dividers formed on the first surface of the substrate, each power divider extending in the same plane as the radiating portion, each power divider coupled to at least two feed lines, wherein the power dividers operate to split the power between at least two radiating elements.*

* * * * *